United States Patent [19]

Caffarel et al.

[11] 4,129,514

[45] Dec. 12, 1978

[54] SURFACE-ACTIVE COMPOSITION BASED ON NON-IONIC SURFACTANTS

[75] Inventors: Jean-Claude Caffarel, Decines; Bernard Papillon, La Mulatiere; Jean Neel, Lyons, all of France

[73] Assignee: Rhone-Poulenc Industries, Paris, France

[21] Appl. No.: 777,848

[22] Filed: Mar. 15, 1977

[30] Foreign Application Priority Data

Mar. 24, 1976 [FR] France ..... 7608529

[51] Int. Cl.[2] ..... C11D 1/825; C11D 1/72

[52] U.S. Cl. ..... 252/89 R; 252/DIG. 1

[58] Field of Search ..... 252/89 R, DIG. 1

[56] References Cited

U.S. PATENT DOCUMENTS

| | | | |
|---|---|---|---|
| 3,619,119 | 11/1971 | Felletschin et al. | 252/89 X |
| 3,691,081 | 9/1972 | Thompson et al. | 252/DIG. 1 X |
| 3,812,041 | 5/1974 | Inamorato | 252/DIG. 1 X |
| 3,931,033 | 1/1976 | Lohr et al. | 252/DIG. 1 X |
| 3,948,819 | 4/1976 | Wilde | 252/DIG. 1 X |
| 3,953,382 | 4/1976 | Nelson et al. | 252/DIG. 1 X |
| 3,983,078 | 9/1976 | Collins | 252/DIG. 1 X |
| 3,985,670 | 10/1976 | Berg et al. | 252/DIG. 1 X |

FOREIGN PATENT DOCUMENTS 860898 1/1971 Canada.

*Primary Examiner*—Harris A. Pitlick

*Attorney, Agent, or Firm*—McDougall, Hersh & Scott

[57] ABSTRACT

Surface-active composition based on non-ionic surfactants derived from ethoxylated saturated primary fatty alcohols.

The composition is characterized in that it contains a solid mixture at ambient temperature of:

(a) at least one non-ionic surface-active compound A of general formula: $R—(OCH_2CH_2)_nOH$ in which R is a $C_6$ to $C_9$ alkyl group and $n$ is greater than 6 and may be as high as 15, (b) at least one non-ionic surface-active compound B of general formula: $R'—(OCH_2CH_2)_mOH$ in which R′ is a $C_{16}$ to $C_{20}$ alkyl group and $m$ is 6 to 15, in which more than half the groups R and R′ taken separately are linear.

It can be used in detergent formulations, especially pulverulent or liquid syndet compositions for domestic and/or industrial washing and degreasing purposes.

10 Claims, No Drawings

SURFACE-ACTIVE COMPOSITION BASED ON NON-IONIC SURFACTANTS

The present invention relates to a surface-active composition based on non-ionic surfactants derived from ethoxylated saturated primary fatty alcohols, which can be used in particular in detergent formulations.

Certain surface-active compositions are known, containing mixtures of primary linear fatty alcohol fractions with different degrees of ethoxylation.

Thus, according to the publication of T. P. Matson which appeared in the review "Soap and Chemical Specialities" of November 1963, pages 52 to 100, a mixture of equal amounts of a non-ionic surfactant derived from a slightly ethoxylated, approximately $C_{10}$ alcohol, containing 55% by weight of ethoxy groups, i.e., approximately 4.5 ethoxy groups, and a non-ionic surfactant derived from a more ethoxylated, approximately $C_{17}$ alcohol containing 55% by weight of ethoxy groups, i.e., about 7 ethoxy groups, was equivalent in effectiveness to an approximately $C_{13}$ alcohol derivative containing about 5.7 ethoxy groups.

Furthermore, French Pat. No. 2,121,201 describes insoluble non-ionic surfactant mixtures consisting of $C_8$ to $C_{20}$ fatty alcohols ethoxylated by 2 to 6 ethoxy groups, and water-soluble non-ionic surfactants also derived from $C_8$ to $C_{20}$ alcohols but ethoxylated by 8 to 18 ethoxy groups, the resultant mixture being oily or pasty.

French Pat. No. 2,247,531 describes mixtures of products derived from primary alcohols containing 8 to 11 carbon atoms and ethoxylated with between 1 and 5 ethoxy groups, and with products resulting from primary alcohols containing 8 to 15 carbon atoms and ethoxylated with between 5 and 17 ethoxy groups, which can be used to emulsify oils.

Moreover, German patent application No. 2,418,294 describes mixtures of products derived from primary aliphatic alcohols containing 10 to 15 carbon atoms and ethoxylated with between 3 and 10 ethoxy groups, and products derived from primary aliphatic alcohols containing 16 to 22 carbon atoms and ethoxylated with between 3 and 7 ethoxy groups, precipitated on sodium perborate tetrahydrate and intended to be incorporated in a syndet powder.

However, industrial mixtures of such non-ionic surfactants, especially those containing alcohols with a relatively short carbon chain (at most 12 carbon atoms) and which are slightly ethoxylated (less than 6 ethoxy groups) frequently contain non-ethoxylated starting alcohols, which raises problems as regards the smell of wash baths. It has been suggested, in the aforementioned French Pat. No. 2,247,531, to remove these free alcohols by distillation, but this operation considerably modifies the properties of non-ionic surfactants and, consequently, of mixtures thereof. Thus, a $C_8$ alcohol with three ethoxy groups usually contains up to 15% by weight of free octanol, and if this octanol is distilled, the non-ionic surfactant becomes in fact a $C_8$ alcohol with 4.3 ethoxy groups instead of 3 ethoxy groups.

In addition, the thermal stability and resistance to oxidation are unsatisfactory, which is a serious disadvantage since when they are dried by an atomization procedure, usually performed to obtain a detergent powder, a non-negligible amount of the alcohol with a low degree of ethoxylation is lost after the atomization. Furthermore, the oily or pasty mixtures of non-ionic surfactants, such as those of French Pat. No. 2,121,201, are difficult to use in detergent powders since they tend to exude after incorporation. Finally, the mixtures such as those of German patent application 2,418,294 cannot be employed in large amounts (greater than 5% by weight) in detergent powders on account of their low degree of incorporation in sodium perborate tetrahydrate.

The object of the present invention is to obviate the above-mentioned disadvantages and provide a mixture of non-ionic surface-active compounds free or almost free of free short chain alcohols (having a number of carbon atoms less than or equal to nine) and having a thermal stability and resistance to oxidation substantially greater than mixtures of the prior art containing at least one ethoxylated fatty alcohol with less than 6 ethoxy groups. Furthermore, the solid non-ionic surface-active mixtures of the invention do not present any problem as regards exudation when incorporated in relatively large amounts (greater than 5% by weight) in the detergent powders.

In accordance with the practice of this invention, the surface-active composition contains a mixture:

(a) of at least one non-ionic surface-active compound A of the general formula: $R - (OCH_2CH_2)_nOH$ in which R is a $C_6$ to $C_9$ alkyl group, and n is greater than 6 and may be as high as 15, (b) at least one non-ionic surface-active compound B of the general formula: $R' - (OCH_2CH_2)_mOH$ in which R' is a $C_{16}$ to $C_{20}$ group and m is from 6 to 15, in which more than half the groups R and R' taken separately are linear groups, and is characterized in that said composition is solid at ambient temperature and in that it includes:

(i) 2 to 70% by weight of surface-active compound A having an ethoxylation rate of at least 64.7% but less than 72.5% by weight of this compound and 98 to 30% by weight of surface-active compound B which has an ethoxylation rate of from about 47% to less than 62.5% by weight of this compound; or (ii) 2 to 70% by weight of surface-active compound A having an ethoxylation rate of at least 64.7% but less than 72.5% by weight of this compound and 98 to 30% by weight of surface-active compound B having an ethoxylation of at least 62.5% and up to about 73.1% by weight of this compound; or (iii) 10 to 90% by weight of surface-active compound A having an ethoxylation rate of at least 72.5% and up to about 86.6% by weight of this compound and 90 to 10% by weight of surface-active compound B having an ethoxylation rate of from about 47% to less than 62.5% by weight of this compound; or (iv) 10 to 90% by weight of surface-active compound A having an ethoxylation rate of at least 72.5% and up to about 86.6% by weight of this compound and 90 to 10% by weight of surface-active compound B having an ethoxylation rate of at least 62.5% and up to about 73.1% by weight of this compound.

Within the context of the present discussion, each constituent A or B derived from an ethoxylated fatty alcohols fraction is related to the ethoxylated alcohol whose chain length corresponds to the weighted average of the chain lengths of the alcohols constituting the fraction. Thus, a $C_6$ to $C_8$ compound with nine ethoxy groups derived from a fraction containing 50% by weight of $C_6$ alcohols and 50% by weight of $C_8$ alcohols is related to a $C_7$ alcohol with nine ethoxy groups. Furthermore, in this context, the average of ethoxy groups for each constituent derived from a fraction of ethoxylated fatty alcohols is considered, as is customary.

The constituent A of general formula R — $(OCH_2CH_2)_nOH$ where R is an alkyl group containing 6 to 9 carbon atoms may be chosen from the compounds $A_1$ where n is greater than 6 but less than 9, and the compounds $A_2$ where n is 7 to 15. More precisely, the compounds $A_1$ have an ethoxylation rate of at least 64.7%, but less than 72.5% by weight of these compounds, and the compounds $A_2$ have an ethoxylation rate of at least 72.5% and up to about 86.6% by weight, which distinguishes the compounds $A_1$ from the compounds $A_2$.

$A_1$ may more particularly be one of the following compounds of the general formula given above in which: R is a $C_6$ or $C_7$ alkyl where n is greater than 6 but less than 7; or R is a $C_8$ alkyl where n is greater than 6 but less than 8; or R is a $C_9$ alkyl where n is greater than 6 but less than 9; and $A_2$ may more particularly be one of the following compounds of the general formula given above in which: R is a $C_6$ or $C_7$ alkyl where n is from 7 to 15; or R is a $C_8$ alkyl where n is from 8 to 15; or R is a $C_9$ alkyl where n is from 9 to 15.

In the same way, the constituent B of the general formula $R'—(OCH_2CH_2)_mOH$ where R' is an alkyl radical containing 16 to 20 carbon atoms may be chosen from: the compounds $B_1$ where m may take the values from 6 to less than 12, and the compounds $B_2$ where m is from 10 to 15. More precisely, the compounds $B_1$ have an ethoxylation rate of from about 47% to less than 62.5% by weight of these compounds, and the compounds $B_2$ have an ethoxylation rate of at least 62.5% and up to about 73.1% by weight which distinguishes the compounds $B_1$ from the compounds $B_2$.

$B_1$ may more particularly be one of the following compounds included in the general formula given above in which:

R' is a $C_{16}$ or $C_{17}$ alkyl and m is from 6 to less than 10;
or
R' is a $C_{18}$ or $C_{19}$ alkyl and m is from 6 to less than 11;
or
R' is a $C_{20}$ alkyl and m is from 6 to less than 12.

$B_2$ may more particularly be one of the following compounds of the general formula given above in which:

R' is a $C_{16}$ or $C_{17}$ alkyl and m is from 10 to 15; or
R' is a $C_{18}$ or $C_{19}$ alkyl and m is from 11 to 15; or
R' is a $C_{20}$ alkyl and m is from 12 to 15.

In general, European washing practice is to wash synthetic fiber-based textiles such as polyester-cotton at low temperatures (<60° C.), and to wash natural fiber textiles such as cotton at high temperatures (>70° C.).

Some preferred mixtures of non-ionic surfactants of the invention are effective at all temperatures, while others are mainly effective at either low temperatures or at high temperatures.

The compositions of the invention may of course be formulated so as to correspond as far as possible to the different washing conditions, by a suitable choice of the carbon chain length of the fatty alcohol and its ethoxylation rate for each constituent A and B, as well as the respective proportions of the constituents, within the ranges specified hereinabove.

According to a first embodiment of the invention, a constituent A chosen from the group of compounds $A_1$ having an ethoxylation rate of at least 64.7%, but less than 72.5% by weight, as previously defined, may be associated with a constituent B chosen from the group of compounds $B_1$ having an ethoxylation rate of from about 47% to less than 62.5% by weight, also defined above. Compositions which are solid at ambient temperature and lend themselves to formulation of detergent powders are obtained by a suitable choice of the proportions of $A_1$.

As a non-limiting example, a particular embodiment of the invention contains a constituent $A_1$, $C_6$ to $C_9$, ethoxylated by more than 6 and up to less than 7 ethoxy groups, and a constituent $B_1$, $C_{16}$ to $C_{20}$, ethoxylated by 6 to 7 ethoxy groups. This composition is effective for washing at low temperatures (up to 60° C.).

A preferred form of the composition of the invention contains a constituent $A_1$, $C_6$ to $C_9$, ethoxylated by more than 6 and up to less than 7 ethoxy groups, and a constituent $B_1$, $C_{16}$ to $C_{20}$, ethoxylated by 8 to 9 ethoxy groups. This composition has the advantage that it is effective at all temperatures (up to 100° C.).

According to a second embodiment of the invention, a constituent A chosen from the group of compounds $A_1$ as previously defined may be combined with a constituent B chosen from the group of compounds $B_2$ having an ethoxylation rate of at least 62.5% and up to about 73.1% by weight also as defined above. Compositions which are solid at ambient temperature and thus lend themselves to the formulation of detergent powders are obtained by a suitable choice of the proportions of $A_1$.

As a non-limiting example, such a preferred composition may contain a constituent $A_1$, $C_6$ to $C_9$, ethoxylated by more than 6 and up to less than 7 ethoxy groups, and a constituent $B_2$, $C_{16}$ to $C_{20}$, ethoxylated by 12 to 15 ethoxy groups. This composition is suitable for all washing temperatures (ambient to 100° C.).

According to a third embodiment of the invention, a constituent A chosen from the group of compounds $A_2$ having an ethoxylation rate of at least 72.5% and up to about 86.6% by weight, as previously defined, may be combined with a constituent B chosen from the group of compounds $B_1$, also as defined above. Compositions which are solid at ambient temperature and thus lend themselves to the formulation of detergent powders are obtained by a suitable choice of the proportions of $A_2$.

A preferred form of the composition contains a constituent $A_2$, $C_6$ to $C_9$, ethoxylated by 9 to 12 ethoxy groups, and a constituent $B_1$, $C_{16}$ to $C_{20}$, ethoxylated by 6 to 9 ethoxy groups. This composition has the advantage that it is effective at all washing temperatures (ambient to 100° C.).

Another preferred form of the composition contains a constituent $A_2$, $C_6$ to $C_9$, ethoxylated by 14 to 15 ethoxy groups, and a constituent $B_1$, $C_{16}$ to $C_{20}$, ethoxylated by 6 to 9 ethoxy groups. This composition is effective for washing at high temperatures (from 70° to 100° C.).

According to a fourth embodiment of the invention, a constituent A chosen from the group of compounds $A_2$ defined above may be combined with a constituent B chosen from the group of compounds $B_2$, also as defined above. Compositions which are solid at ambient temperature and thus lend themselves to the formulation of detergent powders are obtained by a suitable choice of the proportions of $A_2$.

As a non-limiting example, such a composition may contain a constituent $A_2$, $C_6$ to $C_9$, ethoxylated by 9 to 15 ethoxy groups, and a constituent $B_2$, $C_{16}$ to $C_{20}$, ethoxylated by 12 to 15 ethoxy groups. This composition is effective for washing at high temperatures (from 70° to 100° C.).

The relative proportions of the two types of ethoxylated alcohols contained in the compositions of the invention may vary within wide limits. In general, the amount by weight of ethoxylated alcohol A is 10 to 90% and preferably 20 to 80% by weight, and for the ethoxylated alcohol B is 90 to 10% and preferably 80 to 20%. However, the lower limit of 10% for A may be lowered if, in fact $C_6$ to $C_9$ alcohols containing for example more than 6 and up to 8 ethoxy groups, and included in the group of compounds $A_1$, are used. This lower limit may be about 2% by weight and the upper limit does not exceed 70% and preferably 5 to 50% by weight with respect to the composition, so as to have always a solid mixture at ambient temperature.

Depending on the intended use of the composition of the invention, there may be combined therewith one or more types of constituents and/or numerous additives chosen from other known non-ionic, anionic, cationic and dipolar (Zwitter) ionic surfactants; builders such as phosphates and/or polyphosphates; silicates and sequestering agents; bleaching agents such as per-salts, inorganic and/or organic peroxides; anti-redeposition agents such as cellulose derivatives (carboxymethyl cellulose) or organic synthetic polymers such as soluble polyacrylates and polyesters; enzymes; optical brightening agents; stabilizers; silicone-containing or other anti-foaming agents; dyes and fragrances.

Typical detergent compositions are derived from the following general compositions: Non-ionic surface-active compounds of the invention, 1 to 90% by weight, known non-ionic, anionic, cationic or dipolar (Zwitter) ionic surface-active compounds such as alkyl benzenesulphonates, soaps, ethoxylated alcohols and alkylphenols, and alkylbetaines: 0 to 60% by weight; alkali metal perborate: 0 to 30% by weight; tripolyphosphates: 0 to 80% by weight; enzyme: 0 to 5% by weight; alkali metal and/or alkaline earth metal silicates: 0 to 20% by weight; carboxymethyl cellulose: 0 to 5% by weight; and water: 0 to 90% by weight.

A pulverulent syndet composition intended for domestic washing and degreasing may contain about 1 to 30% by weight of a mixture of non-ionic surfactants of the invention, about 1 to 30% by weight of one or more known surfactants, and about 1 to 90% by weight of a detergent auxiliary chosen from detergent reinforcing agents, heavy metal ion sequestering or precipitation agents, soluble or insoluble porous supports, alkalizing agents, bleaching agents and bleaching auxiliaries, anti-redeposition and dispersing agents, foam inhibitors, inert salts and minor auxiliaries (optical brighteners, dyes and fragrances).

A liquid syndet composition for domestic washing and degreasing (linen, crockery, tiles, floors, sanitary fittings, etc.) may contain about 1 to 60% by weight of a mixture of non-ionic surfactants of the invention, 30 to 90% by weight of water, 0 to 25% by weight of a hydrotropic agent such as an alcohol or a lower aliphatic diol, 0 to 60% by weight of one or more known surfactants, and 0 to 25% by weight of at least one detergent auxiliary from among those mentioned above.

In the same way, the mixture of the invention may be employed in liquid or solid industrial compositions intended, inter alia, for textile bleaching, degreasing wool or metal sheets, and deoiling of fibers.

The object of the following examples is to illustrate the various objects of the invention and should not be considered as limiting.

EXAMPLE 1

The effectiveness of the mixtures was tested by incorporating them in the following detergent formulation:

sodium disilicate $Na_20.2SiO_2$; 6% by wt.
sodium tripolyphosphate $Na_5P_3O_{10}$; 44% by wt.
sodium perborate $NaBO_3.4H_2O$; 15% by wt.
sodium sulphate $Na_2SO_4$; 25% by wt.
tested surface-active composition; 10% by wt.

The washings are carried out in a bath containing 8 g of the above detergent formulation per liter of hard water (33° French hydrotimetric degrees) which is placed in a "Terg-O-tometer" (U.S. Testing Company) stirred at 85 revs. per minute. The washings, which lasted 10 minutes, are followed by rinsing for 2 minutes, while stirring. The effectiveness of the mixtures at low temperatures (60° C.) was tested by washing polyester-cotton tissues (65/35) Ref. 7406 made by Test Fabrics Inc. U.S.A. impregnated with soils according to Spangler's method as described in the Journal of American Oil Chemistry Society 1965 - 42 - pages 723–27, while the effectiveness at high temperatures (80° C.) was tested by washing commercial cotton cloths impregnated with soils prepared by the WFK Company (Krefeld, F.G.R.).

12 × 12 cm squares of soiled cloth are washed in the presence of squares of the same white, unsoiled cloth (2 grey cloth squares and 2 white cloth squares per Terg-O-tometer pot). The whiteness of the different cloths is determined by reflectance measurements with a Gardner reflectometer (model XL 10) provided with a Y filter, made by the Gardner Company (Bethesda, Maryland).

The soil removal effectiveness is defined by the average of the reflectance differences of the soiled (grey) cloths after and before washing. An anti-redeposition effectiveness is also defined by the average of the reflectance differences of the clean (white) cloths washed with the grey cloths, after and before washing.

As a comparison, pure non-ionic surfactants derived from a $C_{10}$ to $C_{14}$ fatty alcohols fraction (20% $C_{10}$, 60% $C_{12}$ and 20% $C_{14}$) were also investigated. It is known that the fractions centered on $C_{12}$ or $C_{14}$ containing between 5 and 8 ethoxy groups are effective for washing synthetic textiles at low temperatures, and that the more highly ethoxylated fractions are effective in washing natural textiles at high temperatures. The $C_{10}$ to $C_{14}$ fractions with 6.5 ethoxy groups (effective at low temperatures with polyester cloths and/or polyester-cotton cloths, ineffective at high temperatures with cotton) and $C_{10}$ to $C_{14}$ fractions with 12 ethoxy groups (effective at high temperatures on cotton, ineffective at low temperatures on polyester) were chosen as controls.

As regard the results obtained, a mixture is considered as effective on polyester-cotton at low temperatures if it removes between 20 and 25 or even more Spangler soil and is considered effective on cotton at high temperatures if it removes between 25 and 30 or even more WFK (Krefeld) soil under the specified conditions of this test. The following tables summarize the results obtained.

| Constituent A | Constituent B | % of A in the mixture | Spangler/ polyester cotton 60° C removal/ redeposition | WFK Krefeld cotton 80° C removal/ redeposition |
|---|---|---|---|---|
| $C_{10}$ to $C_{14}$ fraction, 6.5 OE* | | | 25.65 | 15.92 |
| | | | 0.74 | −14.20 |
| $C_{10}$ to $C_{14}$ fraction, 12 OE* | | | 19.07 | 30.17 |
| | | | 1.52 | −5.10 |
| $C_8$, 6.5 OE | **$C_{16}$–$C_{18}$, 6.5 OE | 50% | 24.89 | 18.10 |
| Constituent $A_1$ | Constituent $B_1$ | | 0.96 | −7.45 |
| $C_8$, 6.5 OE | $C_{16}$–$C_{18}$, 9 OE | 50% | 25.47 | 30.92 |
| Constituent $A_1$ | Constituent $B_1$ | | 1.39 | −3.10 |
| $C_8$, 6.5 OE | $C_{16}$–$C_{18}$, 12 OE | 50% | 24.28 | 28.01 |
| Constituent $A_1$ | Constituent $B_2$ | | 1.52 | −2.04 |
| $C_8$, 6.5 OE | $C_{16}$–$C_{18}$, 15 OE | 50% | 24.22 | 32.62 |
| Constituent $A_1$ | Constituent $B_2$ | | 1.85 | −0.38 |
| $C_8$, 9 OE | $C_{16}$–$C_{18}$, 6.5 OE | 50% | 25.50 | 27.64 |
| Constituent $A_2$ | Constituent $B_1$ | | 1.34 | −7.05 |
| | | 100% | 15.57 | 31.86 |
| | | | 1.53 | −5.35 |
| | | 75% | 22.62 | 29.88 |
| | | | 1.58 | −1.22 |
| $C_8$, 9 OE | $C_{16}$–$C_{18}$, 9 OE | 50% | 25.89 | 29.21 |
| Constituent $A_2$ | Constituent $B_1$ | | 1.65 | −1.80 |
| | | 25% | 20.90 | 28.42 |
| | | | 1.23 | −0.31 |
| | | 0% | 19.89 | 23.86 |
| | | | 1.31 | −8.21 |
| $C_8$, 9 OE | $C_{16}$–$C_{18}$, 12 OE | 50% | 18.13 | 31.62 |
| Constituent $A_2$ | Constituent $B_2$ | | 1.87 | −1.65 |
| $C_8$, 9 OE | $C_{16}$–$C_{18}$, 15 OE | 50% | 18.92 | 29.26 |
| Constituent $A_2$ | Constituent $B_2$ | | 1.82 | −0.66 |
| $C_8$, 12 OE | $C_{16}$–$C_{18}$, 6.5 OE | 50% | 25.15 | 28.43 |
| Constituent $A_2$ | Constituent $B_1$ | | 1.67 | −7.04 |
| $C_8$, 12 OE | $C_{16}$–$C_{18}$, 9 OE | 50% | 25.32 | 32.60 |
| Constituent $A_2$ | Constituent $B_1$ | | 1.98 | −1.07 |
| $C_8$, 12 OE | $C_{16}$–$C_{18}$, 12 OE | 50% | 19.07 | 29.43 |
| Constituent $A_2$ | Constituent $B_2$ | | 1.90 | −2.28 |
| $C_8$, 15 OE | $C_{16}$–$C_{18}$, 9 OE | 50% | 18.81 | 31.79 |
| Constituent $A_2$ | Constituent $B_1$ | | 1.95 | −3.97 |

*OE = ethoxy group

**by $C_{16}$–$C_{18}$ is understood a mixture of 50% by weight of $C_{16}$ alcohols and 50% by weight of $C_{18}$ alcohols, which are ethoxylated by the average number of ethoxy groups indicated.

These results confirm the various possibilities of choice of the non-ionic mixtures as a function of the wash conditions.

EXAMPLE 2

The thermal stability of the products specified hereinbelow was tested by following over a period of 1 to 28 hours, as a function of time, the percentage loss in weight in an aerated oven at 110° per 10 g of products subjected to oxidation under a thin thickness (≃ 2 mm).

Composition (1) of the invention — mixture of: 50% by weight of constituent $A_1$: $C_8$ with 6.5 ethoxy groups ($C_8$, 6.5 OE) and 50% by weight of the two constituents $B_1$: 50% by wt. of $C_{16}$ with 6.5 ethoxy groups ($C_{16}$, 6.5 OE) and 50% by wt. of $C_{18}$ with 6.5 ethoxy groups ($C_{18}$, 6.5 OE).

Composition (2) of the invention — mixture of: 50% by weight of the constituent $A_2$: $C_8$ with 9 ethoxy groups ($C_8$, 9 OE), and 50% by weight of the two constituents $B_2$: 50% by wt. of $C_{16}$ with 9 ethoxy groups ($C_{16}$, 9 OE) and 50% by wt. of $C_{18}$ with 9 ethoxy groups ($C_{18}$, 9 OE).

These two compositions are compared with: a mixture (3) of the prior art consisting of 20% by weight of a $C_8$ saturated primary fatty alcohol with 3 ethoxy groups ($C_8$, 3 OE), and 80% by weight of a $C_{10}$ to $C_{14}$ saturated fatty alcohols fraction consisting of 20% of $C_{10}$, 60% of $C_{12}$ and 20% of $C_{14}$ equivalent to a $C_{12}$ ethoxylated by 6.5 ethoxy groups ($C_{10}$–$C_{14}$, 6.5 OE);

a non-ionic surfactant (4) consisting of a $C_{10}$ to $C_{14}$ saturated primary fatty alcohols fraction composed of 20% by weight of $C_{10}$, 60% by weight of $C_{12}$, and 20% by weight of $C_{14}$, ethoxylated by 6.5 ethoxy groups ($C_{10}$–$C_{14}$, 6.5 OE), and finally a non-ionic surfactant (5) consisting of a $C_{10}$ to $C_{14}$ saturated primary fatty alcohols fraction composed of 20% by weight of $C_{10}$, 60% by weight of $C_{12}$, and 20% by weight of $C_{14}$, ethoxylated by 9 ethoxy groups ($C_{10}$–$C_{14}$, 9 OE).

The stability results are summarized in the following table:

| Time in Hours | (1) 50% $C_8$, 6.5 OE 50% $C_{16}$–$C_{18}$, 6.5 OE | (2) 50% $C_8$, 9 OE 50% $C_{16}$–$C_{18}$, 9 OE | (3) 20% $C_8$, 3 OE 80% $C_{10}$–$C_{14}$, 6.5 OE | (4) $C_{10}$–$C_{14}$ 6.5 OE Fraction | (5) $C_{10}$–$C_{14}$ 9 OE Fraction |
|---|---|---|---|---|---|
| 1 | 1.72% | 0.98% | 3.9% | 2% | 1.04% |
| 2 | 2.6% | 1.25% | 6.0% | 2.8% | 1.64% |
| 5 | 4.9% | 2.7% | 9.1% | 5.16% | 3.3% |
| 22 | 15.8% | 10.5% | 27.3% | 20.8% | 13.0% |
| 28 | 20.8% | 13.9% | 33.3% | 26.7% | 16.6% |

It is surprisingly found that the composition (1) of the invention is more stable than the ethoxylated fraction (4) and is much more stable than the prior art mixture (3). It may be noted that the $C_8$ 3 OE compound used for this mixture (3) contains 15% by weight of $C_8$ aliphatic saturated alcohol; the mixture thus contains 3% of octanol at the start and it is found that after 2 hours at 110° C. the difference between the weight losses of (3) and (4) is greater than 3%. The same thermal stability results are obtained using a $C_8$ 3 OE previously distilled in order to remove the free octanol.

In the same way, it is found that the composition (2) of the invention is more stable than the non-ionic surfactant composition (5).

EXAMPLE 3

The storage behavior was examined in the case of syndet powders consisting of an atomized powder subsequently mixed with sodium perborate and having almost no water of addition (except the water of constitution of the perborate), said powders containing:

| | % by weight |
|---|---|
| sodium disilicate | 6 |
| sodium tripolyphosphate | 44 |
| sodium sulphate | 25 |
| sodium perborate 4 $H_2O$ | 15 |
| surface-active composition 1, 2 or 3 as defined hereinbelow, which is added by heat spraying | 10 |

Surface-active composition (1) — Mixture solid at ambient temperature of:

50% by weight of constituent $A_2$: $C_8$ 9 OE and (50% by wt. of $C_{16}$ 9 OE) 50% by weight of the constituents $B_1$:

(50% by wt. of $C_{18}$ 9 OE)

Surface-active composition (2) — Mixture solid at ambient temperature of: 50% by weight of constituent $A_1$: $C_8$ 6.5 OE and (50% by wt. of $C_{16}$ 6.5 OE) 50% by weight of the constituents $B_1$: (50% by wt. of $C_{18}$ 6.5 OE)

Surface-active composition (3) — Mixture of the prior art, liquid at ambient temperature, and consisting of: 20% by weight of $C_8$ 3 OE; 80% by weight of a $C_{10}$ to $C_{14}$ fraction consisting of 20% by weight of $C_{10}$, 60% by weight of $C_{12}$, and 20% by weight of $C_{14}$, equivalent to a $C_{12}$ ethoxylated by 6.5 OE.

250 g of each powder (1), (2) and (3) was stored in a rectangular parallelepiped container having dimensions 15 × 10 × 3 cm, consisting of cardboard impregnated on its external surface with an impermeable wax film, the container being generally of the type used for syndet powders, and these three packets were left for a month in an atmosphere maintained at 25° C. and at a relative humidity of 70%.

The following results were found after storage:

the powder flowed from packet (1) in a manner similar to that observed for freshly prepared powder; no clumping was observed and the inner walls of the packet are free of any apparent greasy stains.

the powder from packet (2) flows slightly less well than freshly prepared powder, this being due to the presence of crumbly lumps. The inner walls of the carton are slightly stained with grease, especially at the bottom, but there are no external stains.

the powder from packet (3) is lumpy and sticky, with a marked tendency to stick to the walls; the inner walls of the carton are all greasy, as are the outer walls at the base of the container.

It is clear that the mixture (1) of the invention has an excellent storage behavior and that the mixture (2) is acceptable and much better than the mixture (3) of the prior art, whose storage behavior is poor.

Compounds of type A of general formula R — $(OCH_2 — CH_2)_nOH$ wherein R is a $C_6$ to $C_9$ alkyl group and n is greater than 6 and up to 15 referred to hereinabove may be obtained as is known in the art by condensation of at least one alkanol of formula R — OH with at least one polyethyleneglycol of formula $H(OCH_2 CH_2)_nOH$ wherein R and n are as mentioned above, and more particularly with a mixture of polyethyleneglycols defined by the latter formula and differing from each other by the number of — $(OCH_2 CH_2)$— groups, said mixture having an average number of — $(OCH_2 CH_2)$— groups greater than 6 and up to 15.

Representative of the $C_6$–$C_9$ alkanols are hexanols, heptanols, octanols and nonanols, having at least 50% of their alkyl groups of a linear structure, and more particularly mixtures thereof in any proportions. Also contemplated are mixtures of said $C_6$–$C_9$ alkanols with the higher alkanols such as decanols and/or dodecanols and/or tetradecanols also having at least 50% of their alkyl groups of a linear structure in proportions such that the average number of carbon atoms of the various alkyl groups in the mixture of alkanols is from 6 to 9.

Similarly, compounds of type B of general formula R′ — $(OCH_2 CH_2)_m$ OH wherein R′ is a $C_{16}$ to $C_{20}$ alkyl group and m is from 6 to 15 also referred to hereinabove may be obtained by condensation of at least one alkanol of formula R′ — OH with at least one polyethyleneglycol of formula $H(OCH_2 CH_2)_m$ OH wherein R′ and m are as indicated above, and more particularly with a mixture of various polyethyleneglycols defined by the latter formula and differing from each other by the number of — $(OCH_2 CH_2)$— groups, said mixture having an average number of — $(OCH_2 CH_2)$— groups in the range from 6 to 15.

Representative of the $C_{16}$–$C_{20}$ alcanols are hexadecanols, heptadecanols, octadecanols, nonadecanols and eicosanols having at least 50% of their alkyl groups of a linear structure, and more particularly mixtures thereof in any proportions. Also contemplated are mixtures of said $C_{16}$–$C_{20}$ alkanols with the lower alkanols such as decanols and/or dodecanols and/or tetradecanols also having at least 50% of their alkyl groups of a linear structure, in proportions such that the average number of carbon atoms of the various alkyl groups in the mixture of alkanols is from 16 to 20.

We claim:

1. Non-ionic surface active composition useful for washing and degreasing containing a mixture of:

(a) at least one non-ionic surface-active compound A of general formula: R—$(OCH_2CH_2)_nOH$ in which R is a $C_6$ to $C_9$ alkyl group and n is greater than 6 and up to 15 and, (b) at least one non-ionic surface-active compound B of the general formula: R′—$(OCH_2CH_2)_mOH$ in which R′ is a $C_{16}$ to $C_{20}$ alkyl group and m is from 6 to 15, and wherein more than half the groups R and R′ taken separately are linear, characterized in that said composition is solid at ambient temperature and in that it includes:

(i) 2 to 70% by weight of surface-active compound A having an ethoxylation rate of at least 64.7% but less than 72.5% by weight of this compound and 98 to 30% by weight of surface-active compound B which has an ethoxylation rate of from about 47% to less than 62.5% by weight of this compound: or (ii) 2 to 70% by weight of surface-active compound A having an ethoxylation rate of at least 64.7% but less than 72.5% by weight of this compound and 98 to 30% by weight of surface-active compound B having an ethoxylation rate of at least 62.5% and up to about 73.1% by weight of this compound; or (iii) 10 to 90% by weight of surface-active compound A having an ethoxylation rate of at least 72.5% and up to about 86.6% by weight of this compound and 90 to 10% by weight of surface-active compound B having an ethoxylation rate of from about 47% to less than 62.5% by weight of this compound; or (iv) 10 to 90% by weight of surface-active compound A having an ethoxylation rate of at least 72.5% and up to about 86.6% by weight of this compound and 90 to 10% by weight of surface-active compound B having an ethoxylation rate of at least 62.5% and up to about 73.1% by weight of this compound.

2. Non-ionic surface-active composition as claimed in claim 1, paragraph (i), characterized in that it contains 5 to 50% by weight of surface-active compound A and 95 to 50% by weight of surface-active compound B.

3. Non-ionic surface-active composition as claimed in claim 1, paragraph (ii), characterized in that it contains 5 to 50% by weight of surface-active compound A and 95 to 50% by weight of surface-active compound B.

4. Non-ionic surface-active composition as claimed in claim 1, paragraph (iii), characterized in that it contains 20 to 80% by weight of surface-active compound A and 80 to 20% by weight of surface-active compound B.

5. Non-ionic surface-active composition as claimed in claim 1, paragraph (iv), characterized in that it contains 20 to 80% by weight of surface-active compound A and 80 to 20% by weight of surface-active compound B.

6. Non-ionic surface-active composition as claimed in claim 1, paragraph (i), characterized in that the surface-active compound A is a $C_6$ to $C_9$ component ethoxylated by more than 6 but less than 7 ethoxy groups and surface-active compound B is a $C_{16}$ to $C_{20}$ component ethoxylated by 8 to 9 ethoxy groups.

7. Non-ionic surface-active composition as claimed in claim 1, paragraph (ii), characterized in that the surface-active compound A is a $C_6$ to $C_9$ component ethoxylated by more than 6 but less than 7 ethoxy groups and surface-active compound B is a $C_{16}$ to $C_{20}$ component ethoxylated by 12 to 15 ethoxy groups.

8. Non-ionic surface-active composition as claimed in claim 1, paragraph (iii), characterized in that the surface-active compound A is a $C_6$ to $C_9$ component ethoxylated by 9 to 12 ethoxy groups and surface-active compound B is a $C_{16}$ to $C_{20}$ component ethoxylated by 6 to 9 ethoxy groups.

9. Pulverulent syndet composition which can be used for washing and degreasing, containing about 1 to 30% by weight of at least one known surfactant, about 1 to 90% by weight of at least one detergent auxiliary, characterized in that it contains about 1 to 30% by weight of non-ionic surfactants of claim 1.

10. Liquid syndet composition which can be used for washing and degreasing, containing 30 to 90% by weight of water, 0 to 25% by weight of a hydrotropic compound, 0 to 60% by weight of at least one known surfactant, 0 to 25% by weight of at least one detergent auxiliary characterized in that it contains about 1 to 60% by weight of non-ionic surfactants claimed in claim 1.

* * * * *